US005346734A

United States Patent [19]

Wydick, Jr.

[11] Patent Number: 5,346,734

[45] Date of Patent: Sep. 13, 1994

[54] PERFORATED LATEX ORAL POUCH FOR LOOSE SNUFF

[75] Inventor: Richard A. Wydick, Jr., Columbus, Ohio

[73] Assignee: Bethanie K. Wydick, Columbus, Ohio

[21] Appl. No.: 47,023

[22] Filed: Apr. 16, 1993

[51] Int. Cl.[5] ..... B32B 1/06; A24B 15/30

[52] U.S. Cl. ..... 428/36.5; 428/36.9; 131/271; 131/275; 131/367; 206/245; 206/260; 206/264

[58] Field of Search ..... 428/36.5, 36.9, 304.4, 428/322.7; 206/242, 245, 260, 264, 268, 271; 131/271, 275, 367

[56] References Cited

U.S. PATENT DOCUMENTS 4,071,036 1/1978 Jacobs ..... 131/187

4,911,181 3/1990 Vromen et al. ..... 131/273

*Primary Examiner*—Jenna L. Davis

*Assistant Examiner*—Blaine R. Copenheaver

[57] ABSTRACT

An oral pouch that is constructed of an orally safe natural rubber material that can be packed with any brand or flavor of loose moist snuff, by the individual user. The pouch is sized using scissors for maximum comfort and fit, and once inserted between the lower gum and lip, serves as a barrier between the tobacco product and the lip and gum area, therefore reducing the direct physical contact of the tobacco product against the gum and lip. Because the pouch is perforated, saliva flows through the pouch moistening the tobacco, creating the tobacco juice.

1 Claim, 2 Drawing Sheets

PERFORATED LATEX ORAL POUCH FOR LOOSE SNUFF

BACKGROUND

1. Field of Invention

The present invention relates generally to a snuff pouch, and more particularly to a perforated latex oral pouch to be used with all brands of snuff on the market.

BACKGROUND

2. Description of Prior Art

Snuff pouches have been on the market for several years, however the pouches that are now available are constructed of a tea bag type paper material. The pouches are pre-packed with loose moist snuff as a part of a manufacturing process, such as U.S. Pat. No. 4,607,479 titled "Apparatus For Packaging Given Quantities Of Snuff" of Linden (1986) which shows how a metered portion of loose snuff is packed into a single sized paper pouch and sealed as a manufacturing process. The pouches are then packaged into a small can which is sealed to preserve the moisture of the snuff in the individual pouches, and shipped to market for consumption.

Loose snuff (snuff that has not been pre-packed into a tea bag type paper material pouch by a manufacturer) is also packaged by weight in a small can and sealed for freshness. Every brand and flavor of snuff on the market is available in loose form, however there is only one flavor from a single manufacturer that is available in loose form as well as pre-packed pouch form. The method of use differs between the two forms of snuff. When a can of loose snuff is purchased the seal on the can is broken, and the lid is removed. The user then inserts the forefinger and thumb into the can and extracts a "pinch" of snuff, and pack's the loose snuff into the lower gum and lip area of the mouth. With this method of consumption the loose snuff has a tendency to float throughout the oral cavity. When a can of snuff is purchased that is filled with portion pouches the user breaks the seal on the can, removes the lid and simply removes one of the pouches of snuff and inserts the pouch in-between the lower lip and gum area of the mouth. Because the loose snuff is contained in the sealed paper pouch the problem of loose snuff floating throughout the oral cavity is eliminated.

The paper pouches that are pre-packed by a manufacturer work well to stop loose snuff from floating throughout the oral cavity, and the tea bag type paper pouch allows saliva to moisten the snuff creating the "juice".

Several drawbacks to be considered with the portion pouches made of paper from a manufacture are: (1) Of all the brands and flavors of loose snuff to choose from, only one is available in pouch form (2) The paper pouches that are pre-packed and sealed from a manufacturer are only available in a one size fits all application (3) The tea bag type paper that pouches are currently made of provide no protection for the gum and lip area from the tobacco product which is packed into the pouch.

The use of snuff tobacco in loose form, as well as paper pouch form has been medically documented to cause, because of the direct physical contact (A) gum and lip irritation (B) gums that recede from the crowns of teeth thereby exposing roots (C) white or yellow patches often at the site of the mouth where the loose tobacco or paper pouches filled with tobacco are placed in the mouth (D) oral cancer. The tea bag paper material pouches are currently constructed of is not intended to serve as a barrier or insulator between the tobacco product and the gum and lip area, but only to prevent snuff from floating through out the oral cavity.

SUMMARY OF THE INVENTION

The principle object of the present invention is to provide a device or pouch that can be used with all brands or flavors of loose snuff on the market, because loose snuff is packed into the pouch by the individual user and not a manufacturer.

It is also an object of the present invention to provide adequate perforation of the latex oral pouch to allow a sufficient amount of saliva to enter the pouch thereby moistening the snuff product creating the "juice".

Another object is to provide a perforated latex oral pouch manufactured in various shapes, that can also be trimmed with scissors by the individual user to achieve maximum comfort and fit once packed with loose moist snuff, and inserted in the lower gum and lip area.

A further object is to manufacture the perforated latex oral pouch from a non-toxic, orally safe natural latex rubber, which will serve as a barrier and insulator for the gum and lip area from the medically documented harmful tobacco product moist snuff.

An even further object of the present invention is to manufacture a perforated latex oral pouch that because of it's insulating property value, will reduce the amount of direct physical contact of the tobacco product against the lip and gum area, also reducing the amount of habit forming nicotine entering the blood stream, therefore reducing the dependency of the tobacco product.

DETAILED DESCRIPTION OF DRAWINGS

The preferred embodiment is to manufacture a perforated latex oral pouch for loose moist snuff. Several methods of manufacturing are possible: (1) Injection molding (2) Hot pouring (3) Dipping and curing. The following materials; (1) Natural rubber (2) Pure silicone (3) Natural liquid latex are all materials that can be used for the pouch construction, and will serve as an insulating barrier. The preferred, and illustrated method of manufacture is dipping and curing, using natural liquid latex.

Figure 1:
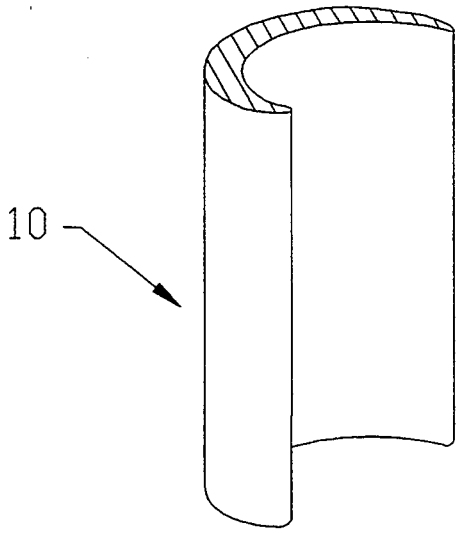
FIG. 1 Perspective view of one example of various shapes of patterns to be used for dipping in liquid latex to manufacture oral pouches.
Figure 2:
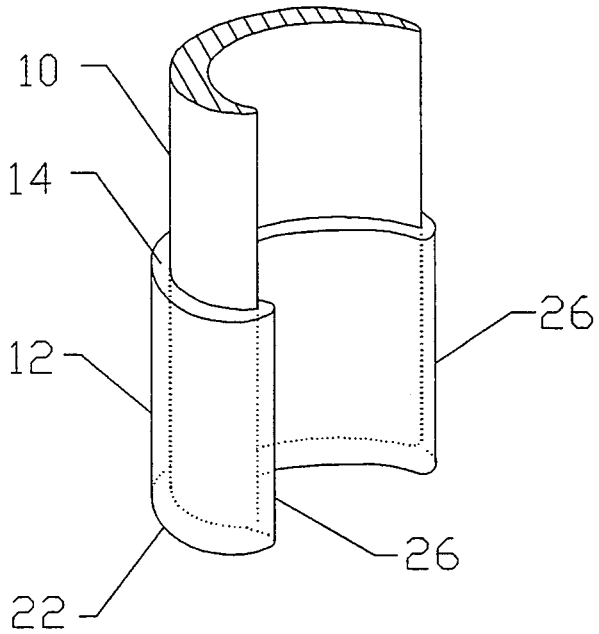
FIG. 2 Perspective view of pattern dipped, and cured to form a full-sized latex pouch.

FIG. 1 shows a pattern (10) made of a material such as, 1. Stainless steel, 2. Aluminum, 3. Acrylic. These materials can be cut, filed, ground, etc. to form a specific shape. The shape of the pattern (10) will determine the shape of the pouch (12) as shown in FIG. 2. FIG. 2 also illustrates the pouch thickness (14) which is approximately 0.025", which can be achieved by dipping pattern (10) any number of times into natural liquid latex and allowing to cure. The pattern (10) is dipped into the liquid latex to a depth of approximately 1". Also illustrated in FIG. 2 are the pouches closed ends (26), and closed bottom (22).

Figure 3:
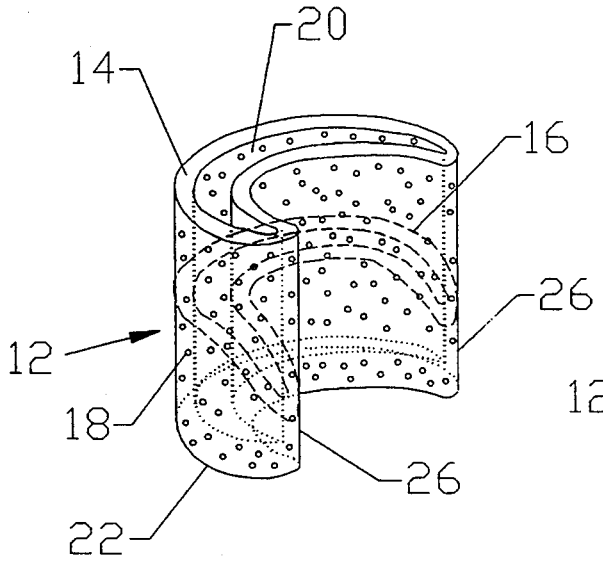
FIG. 3 Perspective view of a cured pouch removed from the pattern that has been thoroughly perforated, and shown in full-size with a dotted line to illustrate an example of custom sizing by the individual consumer.

FIG. 3 shows a pouch (12) removed from the pattern creating the pouch opening (20), two closed ends (26), and a closed bottom (22), and with a universal thickness (14). FIG. 3 also illustrates by a process of either laser or heated metal piercing to create microscopic perforations (18) of the entire pouch (12) to allow saliva to flow through the pouch walls to moisten the contents of the pouch. Also in FIG. 3 is a dotted line (16) shown as an example of sizing a full size pouch (12), by the individual user of the pouch to achieve maximum fit and comfort.

Figure 4:
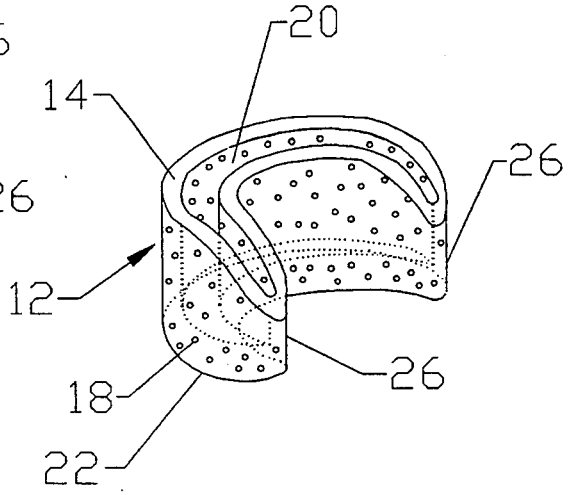
FIG. 4 Perspective view of perforated latex oral pouch cut with scissors to a particular size.

FIG. 4 shows an example of a sized pouch (12). The individual user, using scissors will cut a full sized pouch to achieve maximum fit and comfort. The sized pouch (12) shows the thickness (14), top opening (20), closed bottom (22), closed ends (26), and microscopic perforations (18). The sized pouch (12) is then packed through the top opening (20) by the individual user with any brand, or flavor of loose moist snuff sold. The packed pouch is then inserted into the lower gum, and lip of the mouth for as long as desired by the individual.

Figure 5:
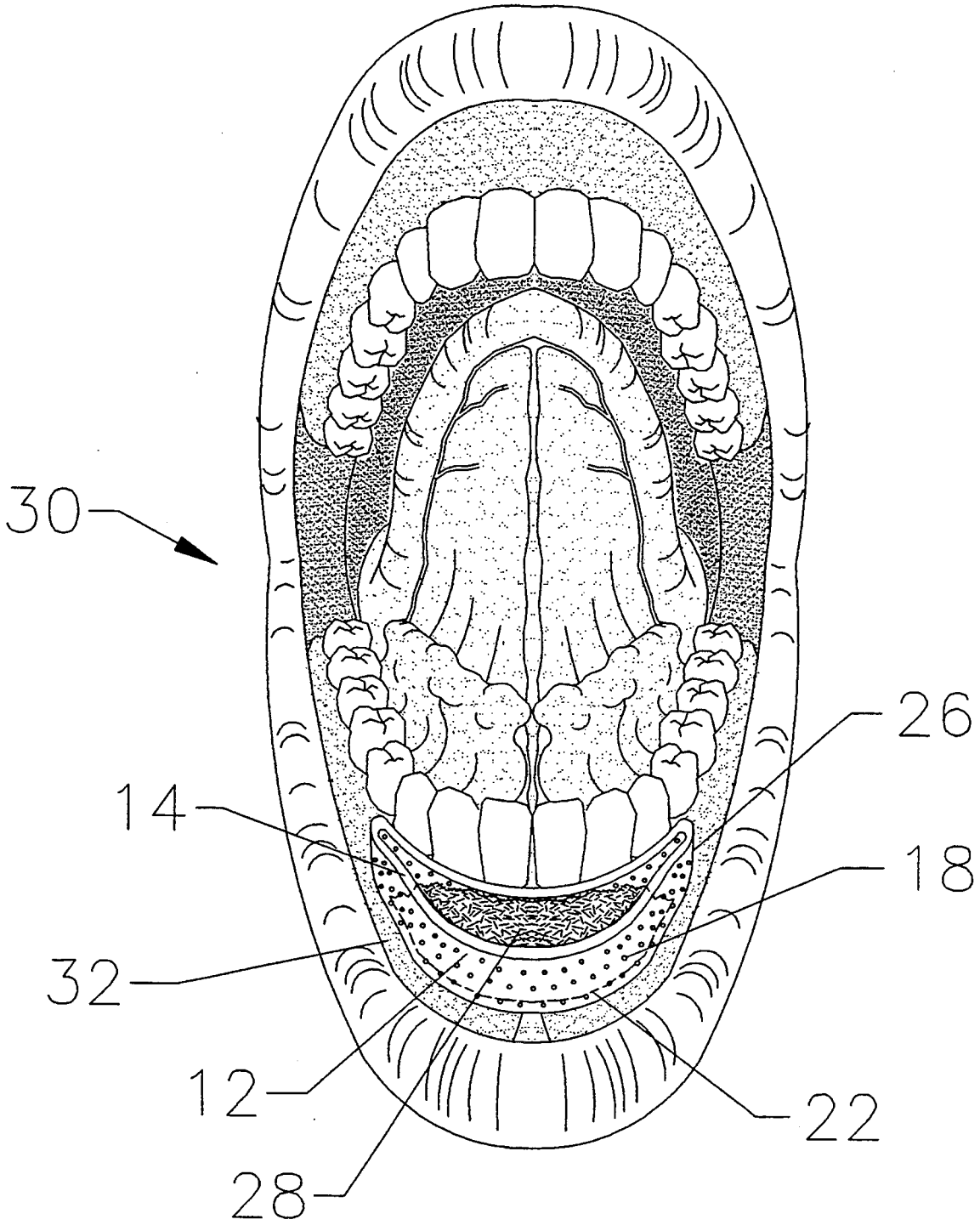
FIG. 5 Perspective view of perforated latex oral pouch cut to fit any particular size gum and lip area, packed with loose moist snuff and inserted in the lower gum and lip area of the mouth.

FIG. 5 shows a sized pouch (12) that has been packed with loose moist snuff (28) by an individual user with any brand or flavor sold, and inserted into the mouth (30) between the lower gum and lip area (32). The microscopic perforations (18) allow saliva to flow freely in and out of the pouch, moistening the snuff packed into the pouch, therefore creating the "juice". FIG. 5 also provides illustration of the effectiveness of the pouch thickness (14) which is approximately 0.025", to serve as a barrier to maximize the insulating properties of the rubber that the pouch is constructed of, thereby virtually eliminating the direct physical contact of the tobacco with the gum and lip area.

The direct physical contact of snuff tobacco with the gum and lip area has been medically documented to cause soreness, and irritation of the gum and lip, as well as white and yellow patches where the snuff is placed. Gradually the gum line recedes exposing the roots of the teeth, along with lesions that form on the gum and lip which have been linked to oral cancer.

What is claimed as invention is:

1. An oral pouch containing loose moist snuff, that is adapted to be inserted into the lower gum and lip area of the mouth in order to reduce the direct physical contact of the tobacco while at the same time moistening the snuff creating the tobacco juice, comprising: a top opening, a closed bottom, and two closed ends, said pouch being constructed of an orally safe insulating material selected from the group consisting of natural rubber, pure silicone, and natural latex rubber, having a thickness of approximately 0.025 inches, said pouch being microscopically perforated to allow saliva to flow through said perforations thereby moistening the packed moist snuff contents of said pouch, said pouch being trimmable with scissors to achieve optimum comfort when inserted into the gum and lip area.

* * * * *